United States Patent [19]

Rohrberg et al.

[11] 4,057,935

[45] Nov. 15, 1977

[54] QUICK RELEASE MECHANISM FOR WINDOW GUARD OR THE LIKE

[75] Inventors: Rod G. Rohrberg, Torrance; Henry Patrick Trentz, Lomita; Victor Herbert Ziegler, Torrance, all of Calif.

[73] Assignees: Rod G. Rohrberg; Henry P. Trentz, both of Torrance, Calif.

[21] Appl. No.: 765,199

[22] Filed: Feb. 3, 1977

[51] Int. Cl.[2] ..... E06B 9/02; E05C 3/28

[52] U.S. Cl. ..... 49/56; 49/141; 292/19

[58] Field of Search ..... 49/56, 50, 57, 61, 67, 49/141; 292/19, 53, 252

[56] References Cited

U.S. PATENT DOCUMENTS

| | | | |
|---|---|---|---|
| 780,417 | 1/1905 | Euphrat | 292/19 |
| 810,923 | 1/1906 | Dobelman | 49/56 |
| 1,866,326 | 7/1932 | Stevens | 292/19 |
| 3,386,758 | 6/1968 | Swearingen | 292/53 |
| 3,466,075 | 9/1969 | Fernandez et al. | 292/19 |
| 3,696,744 | 10/1972 | Etchell | 292/252 X |
| 3,921,334 | 11/1975 | Black, Sr. | 49/56 |

*Primary Examiner*—Philip C. Kannan
*Attorney, Agent, or Firm*—Edward A. Sokolski

[57] ABSTRACT

A guard grille for a window, door, or the like, has a retainer member which is fixedly attached thereto and which is adapted to releasably engage a latching mechanism which is retained on the wall adjacent to a window frame. The latching mechanism includes an inner latching member which is attached to a slidably mounted rod and an outer retainer collet which in the latched position retains the latching member within the retainer member. A spring is placed between the inner latching member and the retainer member, this spring being compressed when the mechanism is in the latched condition. The mechanism is unlatched by means of a knob located adjacent to the inner wall surrounding the window frame, this knob being attached to the rod connected to the inner latching member. Inward actuation of the knob moves the inner latching member away from the retainer collet against the spring, thereby releasing the latching mechanism, the spring and actuation by the operator driving the grille away from the window.

12 Claims, 6 Drawing Figures

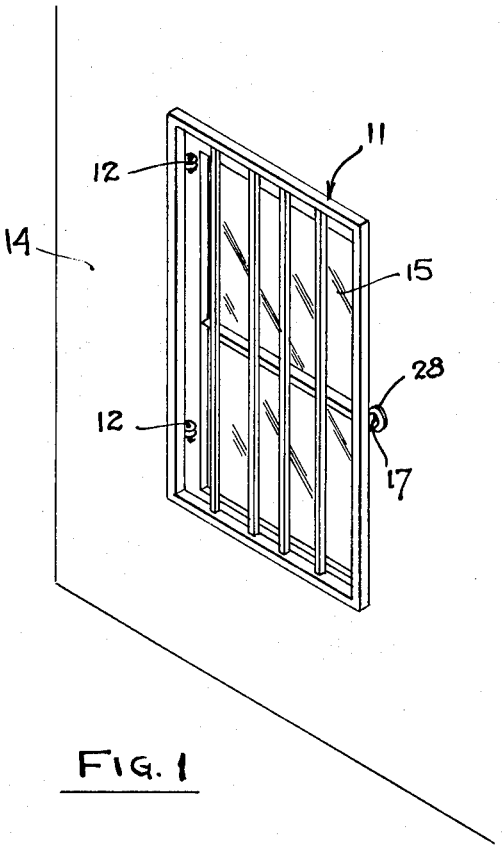
FIG. 1
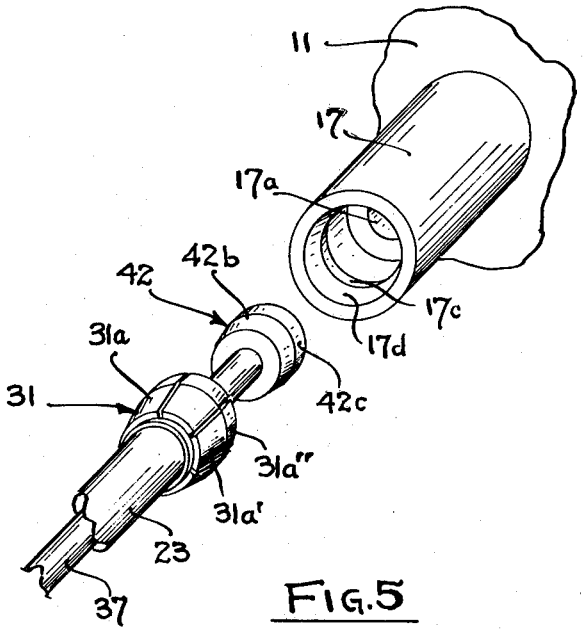
FIG. 5
FIG. 2
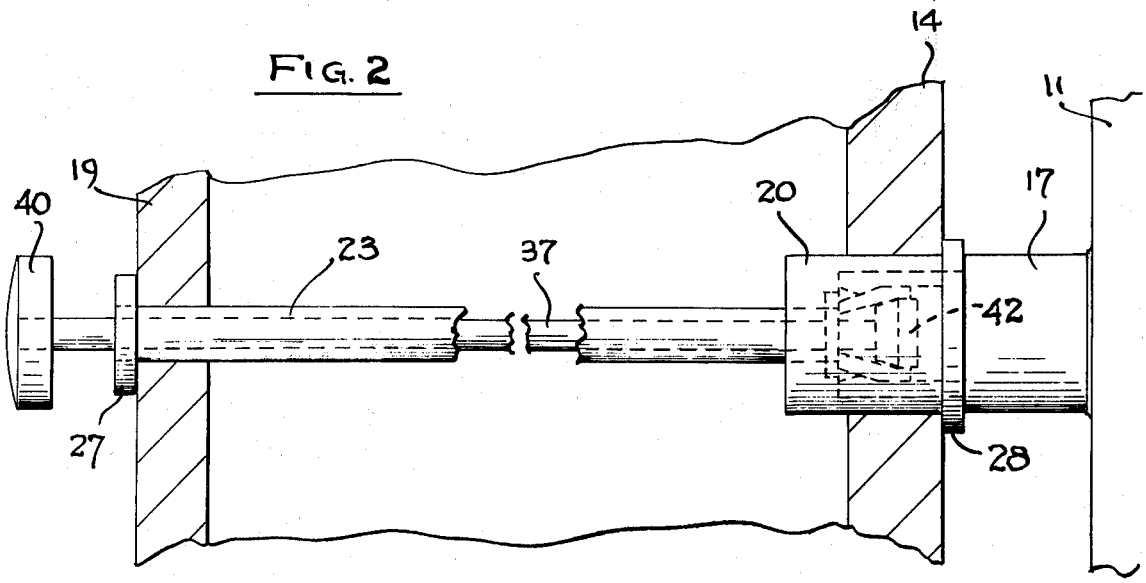

QUICK RELEASE MECHANISM FOR WINDOW GUARD OR THE LIKE

This invention relates to window guards or the like, and more particularly to such a device having a release mechanism incorporated therein for quick opening of the guard.

Window guards and the like, such as grilles and the like, have come into widespread use for security reasons. However, such guards can impose a severe hazard to the occupants of the buildings in the event of fire or other emergency situations which necessitate a rapid exit through the windows, doors, access guards, etc. Many of such guards are fixedly bolted to the building, obviating escape in the event of such an emergency. A number of deaths and severe accidents have resulted from such a condition. Efforts have been made to alleviate this problem by providing release mechanisms for window guards which can be operated from the inside of the building. In order for such devices to be effective, they must be highly reliable in their operation and capable of being operated with a minimum of manual dexterity and thought for their actuation, particularly when one considers that their actuation will be required in an emergency situation where there may be heavy smoke which impairs visibility. Further, to satisfy reliability, it is highly desirable that the device be capable of being fully mechanically actuated and require no electrical power (either battery or line power) for its operation.

A fully mechanically operated latching mechanism for a window grille is described in U.S. Pat. No. 3,921,334. This patent shows two embodiments, one utilizing a pivotally supported latch, the other of which utilizes a butterfly type latching mechanism. In both of these embodiments, the latching mechanisms are located along the inside wall of the building. In the butterfly latching mechanism, the release is achieved by driving the latching mechanism inwardly by means of a plunger, this driving action tending to force the latching dogs against the inside walls of the building. This appears to present a binding problem with actuation which necessitates the application of a substantial amount of pressure by the operator for the release of the latching mechanism. The use of a pivotally mounted latch as shown in the other embodiment presents a possible binding problem at the pivot pin unless it is lubricated at regular intervals. Further, the movement of such a pivotally mounted latch to the release position, while admittedly not difficult for an average person to accomplish under ordinary conditions, could present a problem to a person having low strength and/or low mental capacity under emergency and/or low visibility conditions.

The present invention overcomes the aforementioned shortcomings of the prior art by providing a latching mechanism which securely retains the grille to the building yet can be rapidly and easily released with a minimum amount of effort under emergency conditions. The device of the present invention is fully mechanical in its operation, has inherent high reliability and requires little maintenance to insure its reliable operation. In addition, the device of the present invention operates to drive the grille open with a single actuation by the operator, so that the person on the inside can exit immediately and need not be concerned with pushing the grille open.

It is therefore an object of this invention to improve the safety of window guards.

It is still another object of this invention to provide a safety release mechanism for a window guard grille which has high reliability and which can be operated with minimum effort and thought.

It is still another object of this invention to provide a safety release mechanism for a window guard grille which requires less maintenance than prior art devices.

It is still another object of this invention to provide a safety release mechanism for a window grille which operates to drive the window grille open with a single actuation.

Other objects of this invention will become apparent as the description proceeds in connection with the accompanying drawings, of which:

FIG. 1 is a perspective view illustrating a window grille incorporating the device of the invention;

FIG. 2 is a cross-sectional view illustrating a preferred embodiment of the invention;

FIG. 5 is a perspective view showing the preferred embodiment in its unlatched condition.

Figure 3:
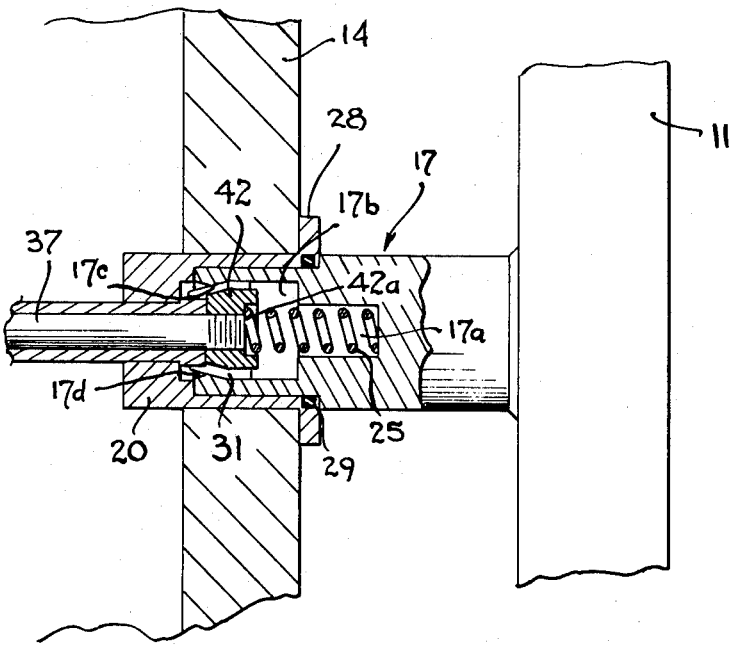
FIG. 3 is a cross-sectional view illustrating the latching mechanism of the preferred embodiment in its latched condition.

Briefly described, the device of my invention is as follows: A retainer assembly which may be in the form of a tubular member having a receptacle formed therein for matingly receiving a latching mechanism is fixedly attached to the inside wall of a window grille. The latching mechanism is mounted on the wall of the building and includes an outer tube which runs between the inner and outer walls of the building and is retained on both of these walls. The outer tube is retained on the outer building wall by means of a sleeve member into which the grille attached retainer assembly fits. A retainer collet having resilient fingers is attached to the end of the outer tube retained on the outer wall. An inner rod member is slidably mounted within the outer tube member and has a latching member fixedly attached to one end thereof which latching member is fitted within the grille receptacle and located adjacent to the collet and a knob on the other end thereof, which is supported adjacent to the inner wall of the building. A spring is placed between the latching member and the end wall of the grille receptacle, this spring urging the latching member against the collet in internal concentricity therewith and the knob away from the inner wall of the building. The latching member forces the retainer collet against an outwardly tapered inner wall portion of the grille receptacle to retain the collet in the grille receptacle in latched engagement therewith, thereby retaining the window grille to the building wall. When the knob is depressed, the rod drives the latching member inwardly, causing it to be withdrawn from the retainer collet, thereby unlatching this collet from the grille receptacle and permitting the window grille to open in response to the expansion of the spring. The grille thus can be easily opened with a minimum of thought and effort by depression of the knob.

Referring now to FIG. 1, the device of the invention is shown as installed in a window grille. Window grille 11 is mounted on hinges 12, which are attached to the outside wall 14 of the building. Grille 11 is placed over window 15 to prevent entry through this window when the grille is latched in place. Fixedly attached to grille 11 is a receptacle member 17 which, as to be explained further on in the specification, releasably receives the latching mechanism connected to wall 14. Fixedly supported on wall 14 is sleeve member 20 into which the end portion of receptacle member 17 is fitted and within which the latching mechanism is retained.

Referring now to FIGS. 2–5, a preferred embodiment of the invention is illustrated. Receptacle member 17 is fixedly attached to grating 11 as, for example, by welding thereto. Receptacle 17 is cylindrical in form and has a first smaller diameter inner cylindrical chamber 17*a* formed therein, into which spring 25 is fitted, and a second wider diameter chamber 17*b* towards the outer end thereof. A first wall portion 17*c* of the receptacle tapers inwardly towards the mouth of the receptacle, while a second wall portion 17*d* tapers outwardly toward the mouth to facilitate the retention of the latching members when they are in their latched condition, yet to permit ready release when the release handle is actuated. The latching mechanism includes a tube member 23 which is supported between the outer wall member 14 and the inner wall member 19 of the building, by means of nut member 27 which threadably engages the tube at one end thereof, and sleeve member 20 to which the tube is fixedly attached as for example by welding. Sleeve 20 is retained on wall 14 by means of annular flange 28. An O-ring 29 is provided between receptacle member 17 and sleeve 20 to prevent water and foreign particles from entering the latching mechanism when the grille is in its latched position. Attached to the very end of tube 23 is retainer collet 31. Collet 31 may be threadably attached to the tube, may be integrally formed with the tube, or may be welded thereto. Spring 25 is not shown in FIG. 5.

As can best be seen in FIG. 5, collet 31 is fabricated of a resilient material and has a plurality of resilient fingers 31*a* which are capable of being squeezed inwardly or expanded outwardly, in response to inwardly or outwardly directed pressure. The fingers 31*a* have flared portions 31*a'* which flare outwardly from tube 23, and non-flared peripheral portions 31*a''*. Slidably mounted within tube member 23 is rod member 37. Fixedly attached to one end of rod member 37 is a knob 40. Latch member 42 is threadably attached to the other end of rod member 37. Latch member 42 may alternatively be fixedly attached to the rod member, as for example by welding, or may be integrally formed therewith. Latch member 42 has a recess 42*a* formed therein (see FIG. 3) into which spring 25 is fitted. Latch member 42 also has a tapered portion 42*b*, in the shape of a truncated cone, and a non-tapered cylindrical portion 42*c* which fit within and matingly engage flared portion 31*a'* and non-flared portion 31*a''* of the collet, respectively.

Figure 4:
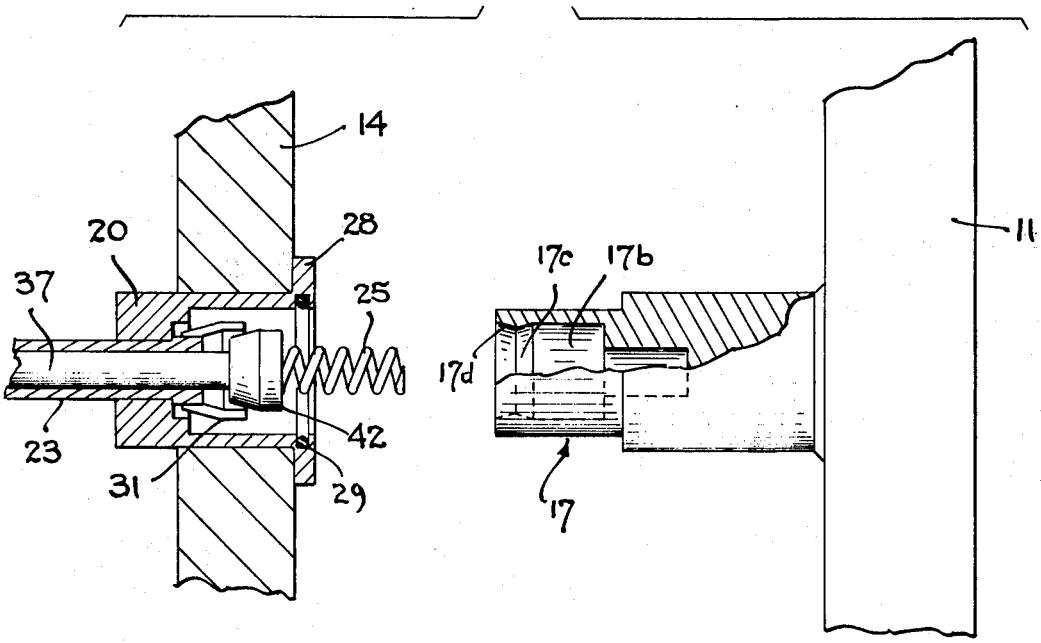
FIG. 4 is a cross-sectional view illustrating the preferred embodiment in its unlatched condition.

Referring now to FIGS. 2 and 3, latch member 42 is shown in the latched condition, retained within receptacle 17 by means of retainer collet 31 which is tightly squeezed between the walls of latch member 42 and receptacle 17. Referring now to FIGS. 4 and 5, when knob 40 is depressed inwardly towards wall 19, latch member 42 is driven out of collet 31. When this occurs, spring 25 is enabled to drive receptacle 17 and along with it grille guard 11, away from wall 14 in view of the fact that the collet fingers are no longer being prevented from being pressed inwardly by the latching member and will be so pressed by the walls of receptacle 17 in response to the outwardly urging action of spring 25. It is to be noted that spring 25 provides sufficient thrust against receptacle 17 to drive the grating open, thus affording immediate egress from the window.

Figure 6:
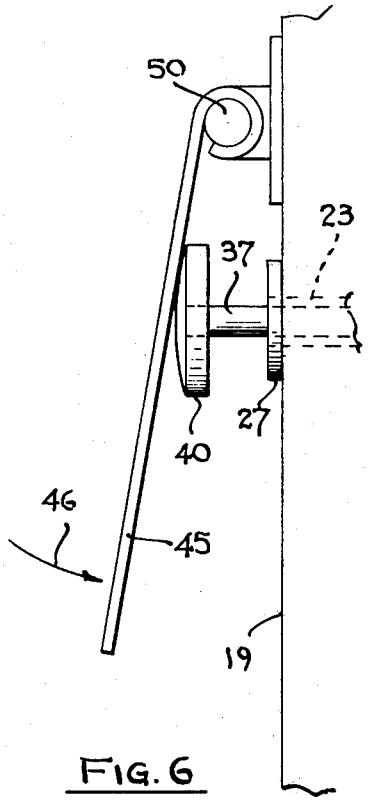
FIG. 6 is a side elevational view illustrating a lever mechanism which may be used to facilitate the actuation of the handle mechanism of the preferred embodiment.

Referring now to FIG. 6, a lever mechanism is illustrated which may be used in conjunction with the present invention in situations involving persons having very little strength, such as for example in hospitals and homes for the elderly. In such situations, a lever bar 45 which is pivotally mounted on wall 19 by means of hinge mechanism 50, is provided to actuate knob 40 as indicated by arrow 46.

While the invention has been described and illustrated in detail, it is to be clearly understood that this is intended by way of illustration and example only and is not to be taken by way of limitation, the spirit and scope of this invention being limited only by the terms of the following claims.

I claim:

1. A quick release latching device for releasably securing a guard to a wall surrounding an opening in said wall, comprising:

a tube member supported on said wall and extending between inner and outer portions of said wall, a sleeve member mounted on an outer portion of said wall and attached to said tube member near one end of said tube member, a rod member slidably mounted within the tube member and extending from a point beyond the inner surface of said wall to a point within said sleeve member, a latching member attached to the end of said rod member extending within said sleeve member, manually operable actuator member attached to the end of said rod member extending beyond the inner surface of said wall, a resilient retainer collet attached to said one end of said tube member proximate to where the sleeve member is attached thereto, and retainer means attached to said guard and having a receptacle formed therein for receiving said retainer collet, said latching member forcing said collet against the inner wall of said receptacle to secure the sleeve member to the receptacle when the device is in the latched condition, said sleeve member being released from the receptacle when the actuator member is depressed towards the inner wall surface to draw the latching member away from the collet.

2. The latching device of claim 1 wherein said retainer means and said sleeve member are tubular, at least a portion of said retainer means fitting within said sleeve member in internal concentricity therewith.

3. The latching device of claim 1 and further including spring means placed between said latching member and said receptacle for resiliently urging said receptacle away from said latching member whereby when the actuator member is depressed to draw the latching member away from the collet, said spring means drives the latching member and the receptacle away from each other.

4. The device of claim 1 wherein said collet comprises a plurality of flared resilient fingers adapted to be squeezed inwardly or expanded outwardly in response to inwardly or outwardly directed pressure respectively, said latching member having a tapered portion which drives said fingers outwardly against the inner wall of said receptacle when the device is in the latched condition.

5. The device of claim 4 wherein said receptacle has a first wall portion which tapers inwardly towards the mouth of the receptacle, and a second wall portion adjacent to said first wall portion and located at the mouth of said receptacle which tapers outwardly from said first wall portion.

6. The latching device of claim 3 wherein the spring means comprises a coil spring, said latching member having a recess formed therein into which one end of the spring is fitted, the receptacle having a chamber formed therein into which the other end of the spring is fitted.

7. The latching device of claim 1 and further including a pivotally mounted lever bar for use in actuating said actuator member.

8. In a window guard grille for covering a window, a quick release latching device for securing said grille to a wall surrounding said window comprising:

a sleeve member fixedly attached to an outer portion of said wall and extending through said outer wall portion, a tube member attached near one end thereof to said sleeve and mounted within said sleeve in internal concentricity therewith and attached to an inner portion of said wall at the other end thereof, a collet member attached to said one end of said tube member and having a plurality of resilient fingers flaring out from the end of said tube member, a rod member slidably mounted within said tube member in internal concentricity therewith, one end of said rod member extending through said inner wall portion beyond the other end of said tube member, the other end of said rod member extending through said one end of said tube member to within said sleeve member, a latching member attached to the other end of said rod member, said latching member having a truncated conical portion tapering in the direction towards said one end of the rod member, a knob attached to said one end of said rod member for manually actuating said rod member, and a receptacle member attached to said guard grille having a tubular portion which fits within said sleeve member in internal concentricity therewith, said tubular portion forming a chamber which receives said collet and latching members, said latching member operating to spread the resilient fingers of the collet against the inner wall of the chamber to secure the sleeve member to the receptacle member when the device is in the latched condition, said sleeve member being released from the receptacle member when the rod member is actuated to draw the latching member away from the collet thereby permitting the resilient fingers to be forced inwardly.

9. The latching device of claim 8 and further including spring means placed between said latching member and said receptacle member for resiliently urging said receptacle member away from said latching member whereby when the knob is actuated to draw the latching member away from the collet, said spring means drives the latching member and the receptacle member away from each other.

10. The latching device of claim 9 wherein the spring means comprises a coil spring, said latching member having a recess formed therein into which one end of the spring is fitted, the receptacle member having a second chamber formed therein into which the other end of the spring is fitted.

11. The device of claim 8 wherein said receptacle member has a first wall portion which tapers inwardly towards the mouth of the receptacle member, and a second wall portion adjacent to said first wall portion and located at the mouth of said receptacle member which tapers outwardly from said first wall portion.

12. The latching device of claim 8 and further including a pivotally mounted lever bar for use in actuating said knob.

* * * * *